US007442084B2

(12) United States Patent
Montena

(10) Patent No.: US 7,442,084 B2
(45) Date of Patent: Oct. 28, 2008

(54) FILTER HOUSING

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 259 days.

(21) Appl. No.: 11/425,535

(22) Filed: Jun. 21, 2006

(65) Prior Publication Data

US 2007/0298661 A1 Dec. 27, 2007

(51) Int. Cl.
*H01R 13/66* (2006.01)

(52) U.S. Cl. ..... 439/620.03; 439/578; 439/675; 333/185

(58) Field of Classification Search ..... 439/546, 439/551, 578, 675, 620.03; 33/175, 185
See application file for complete search history.

(56) References Cited

U.S. PATENT DOCUMENTS

| | | | | |
|---|---|---|---|---|
| 2,642,474 | A | 6/1953 | Bowar | |
| 3,104,145 | A | 9/1963 | Somerset | |
| 3,292,136 | A | 12/1966 | Somerset | |
| 3,354,926 | A | 11/1967 | Mattick | |
| 4,441,781 | A | 4/1984 | Forney, Jr. et al. | |
| 4,557,546 | A | 12/1985 | Dreyer | |
| 4,598,967 | A | 7/1986 | White | |
| 4,688,877 | A | 8/1987 | Dreyer | |
| 5,127,853 | A | 7/1992 | McMills et al. | |
| 5,207,602 | A | 5/1993 | McMills et al. | |
| 5,609,501 | A | 3/1997 | McMills et al. | |
| 5,902,084 | A | 5/1999 | Garcia | |
| D475,975 | S | 6/2003 | Fox | |
| 6,784,760 | B2 * | 8/2004 | Olcen et al. | 333/176 |
| 6,794,957 | B2 * | 9/2004 | Shafer et al. | 333/185 |
| 6,884,113 | B1 | 4/2005 | Montena | |
| 6,930,872 | B2 * | 8/2005 | Palinkas et al. | 361/119 |
| 2002/0192993 | A1 | 12/2002 | Decicco | |
| 2005/0118870 | A1 | 6/2005 | Schreier | |
| 2005/0162238 | A1 * | 7/2005 | Ho | 333/185 |
| 2005/0176294 | A1 | 8/2005 | Montena | |
| 2005/0176296 | A1 | 8/2005 | Montena | |

* cited by examiner

*Primary Examiner*—Michael C Zarroli
(74) *Attorney, Agent, or Firm*—Pastel Law Firm; Christopher R. Pastel

(57) ABSTRACT

A filter housing has a large diameter body with texturing which facilitates tightening without a wrench, although wrench hex flats are provided for the last quarter turn. An integral weather seal is incorporated into the filter housing to eliminate the possibility of installing the wrong seal, improperly installing the correct seal, or omitting the installation of any seal at all.

7 Claims, 3 Drawing Sheets

FILTER HOUSING

FIELD OF THE INVENTION

This invention relates generally to the field of electronic filter housings used in the cable television (CATV) industry, and more particularly to a filter housing with a knurled outer shell and incorporating an integral weather seal.

BACKGROUND OF THE INVENTION

Typical small form CATV trap and filter products are slender and smooth, requiring the use of a wrench to tighten them properly when installing them onto a port. In addition, when used outdoors, they require the use of accessory moisture seals, which if not installed properly, lead to eventual leaking of rain and/or humidity into the filters. U.S. Pat. No. 6,794,957 (Shafer et al.) discloses such a typical filter assembly and housing.

SUMMARY OF THE INVENTION

Briefly stated, a filter housing has a large diameter body with texturing which facilitates tightening without a wrench, although wrench hex flats are provided for the last quarter turn. An integral weather seal is incorporated into the filter housing to eliminate the possibility of installing the wrong seal, improperly installing the correct seal, or omitting the installation of any seal at all.

According to an embodiment of the invention, a filter housing includes an outer body; an inner body; a first portion of the outer body shaped as a wrench hex; a second portion of the outer body having texturing thereon sufficient to permit hand tightening of the filter housing into an equipment port; and a third portion of the outer body having a smooth surface effective to permit affixing indicia thereon.

According to an embodiment of the invention, a method for manufacturing a filter housing includes the steps of: (a) forming an outer body; (b) forming at least one textured portion on the outer body, wherein the textured portion is sufficient to permit hand tightening of the filter housing into an equipment port; (c) forming a smooth portion on the outer body of sufficient size effective to affix indicia on the smooth portion; (d) forming a wrench hex on the outer body sufficient to permit wrench tightening of the filter housing into the equipment port; (e) forming an inner body; and (f) fitting the inner body into the outer body such that the inner body and outer body are connected by an interference fit.

According to an embodiment of the invention, a filter housing includes an outer body; an inner body; a portion of the outer body shaped as a wrench hex; means, on the outer body, for permitting hand tightening of the filter housing into an equipment port; and means, on the outer body, for permitting affixing indicia thereon.

DETAILED DESCRIPTION OF THE PREFERRED EMBODIMENT

Figure 1:
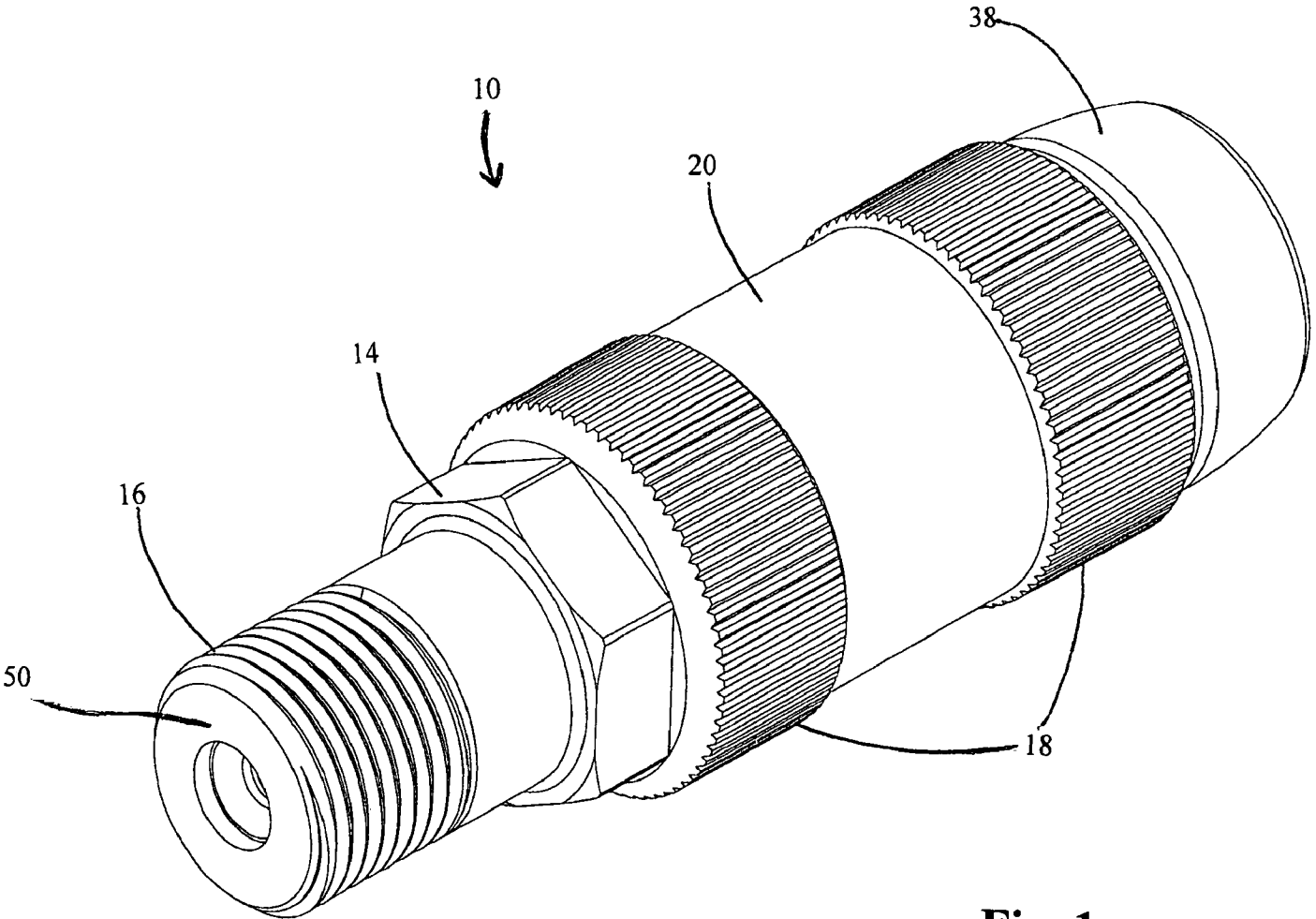
FIG. 1 shows a perspective view of cable connector according to an embodiment of the present invention.
Figure 2:
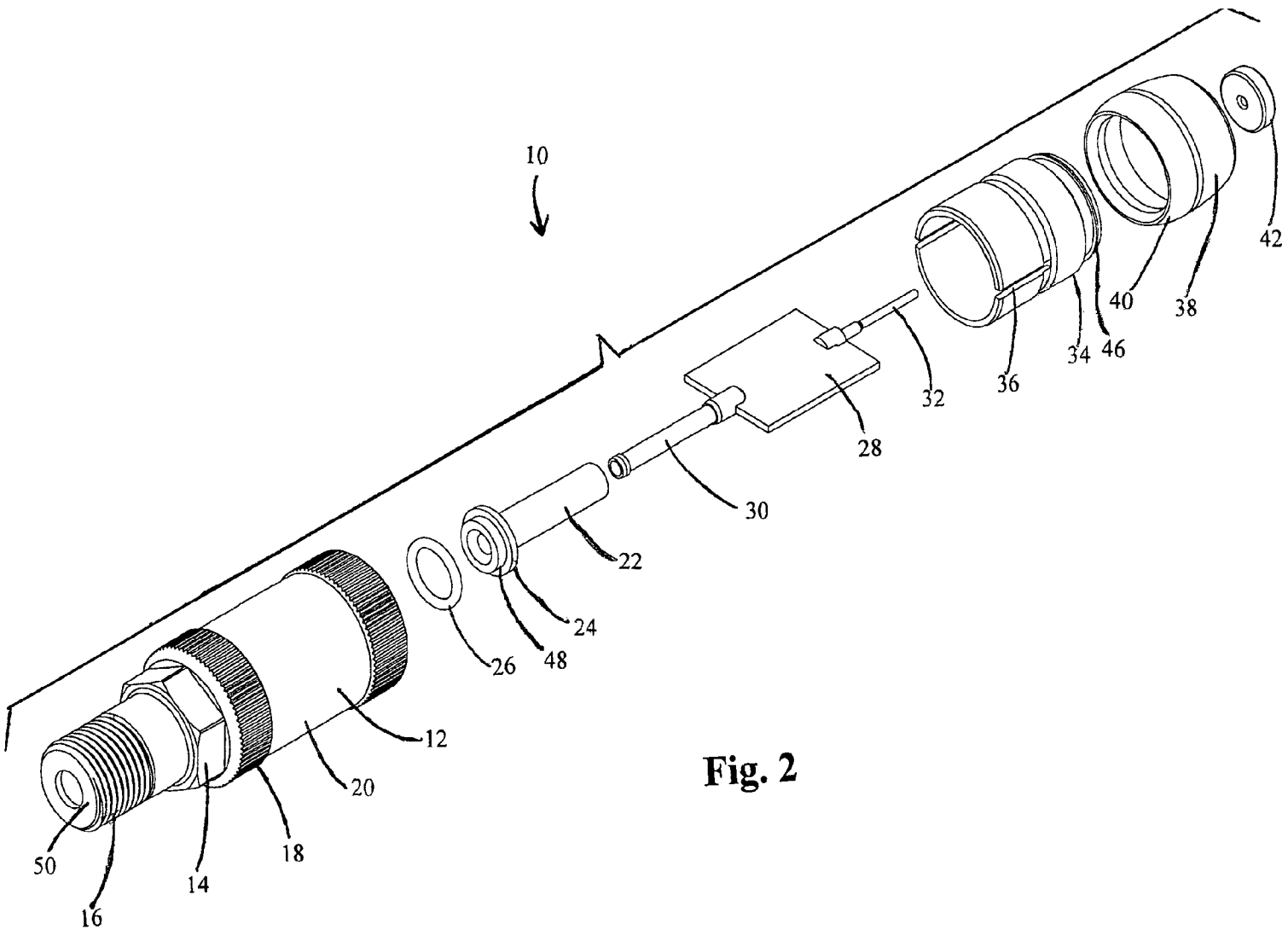
FIG. 2 shows a perspective exploded view of the cable connector of FIG. 1.
Figure 3:
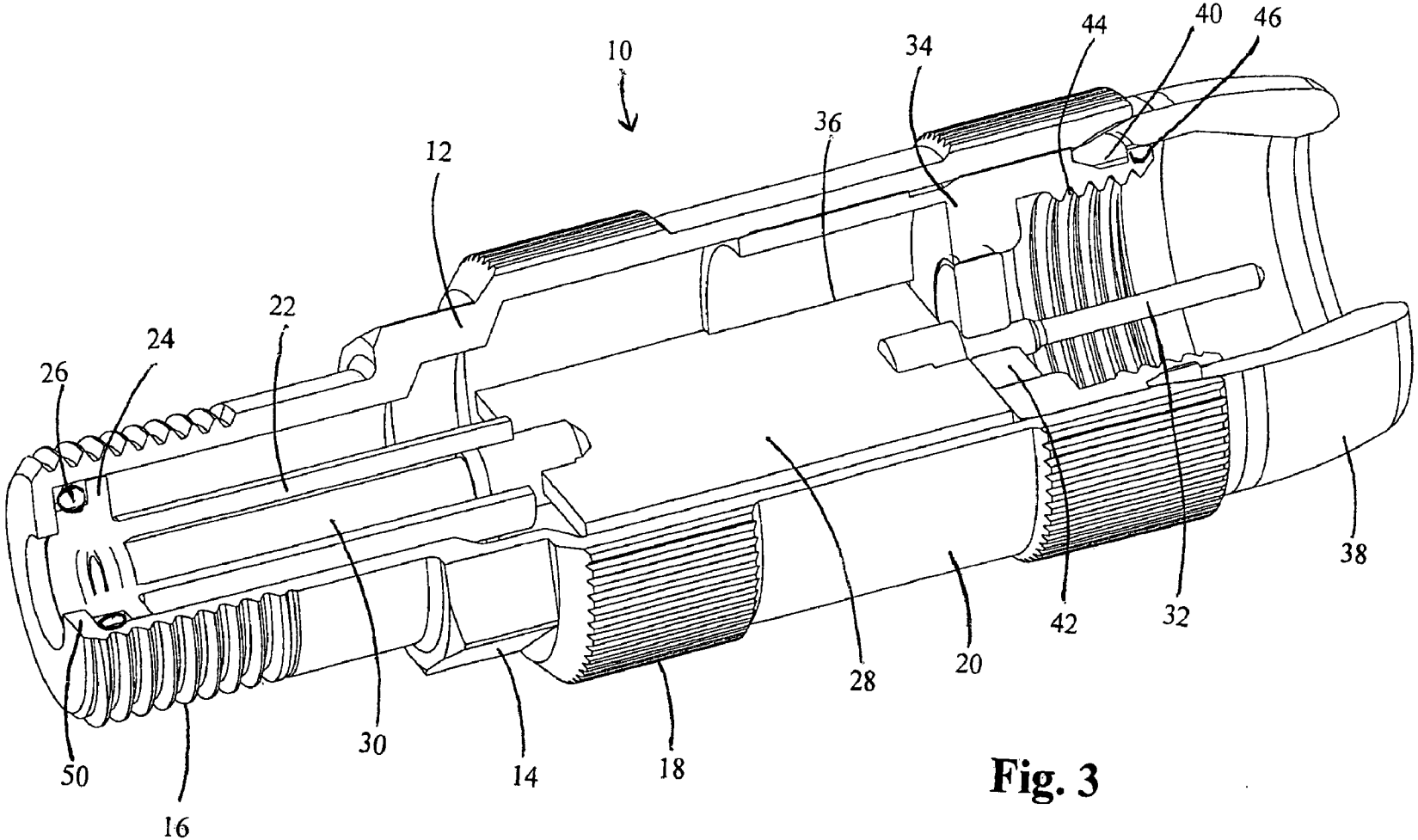
FIG. 3 shows a partial cutaway perspective view of the cable connector of FIGS. 1 and 2.

Referring to FIGS. 1-3, a filter housing 10 according to an embodiment of the invention is shown. A generally cylindrical outer body 12 preferably includes female threading 16 at one end, an integral wrench hex 14 which permits tightening with a wrench, and at least one texturing portion 18. Outer body 12 is preferably of brass for its electrical and mechanical properties, but any conductive material with suitable mechanical properties could be used instead. In the embodiment shown, two texturing portions 18 are shown with a cleared portion 20 between them which permits marking, stamping, or bar coding on outer body 12. Texturing portions 18 are shown as ridges that are parallel with a major axis of outer body 12 and could be formed by extrusion when outer body 12 is formed, in which case cleared portion 20 is preferably machined smooth after outer body 12 is extruded. The texturing of texturing portions 18 could also be diamond knurl or helix knurl.

An inner body includes male threads 44 inside one end for connecting filter housing 10 onto an equipment port (not shown). A circuit board 28, with a filter circuit thereon, preferably fits into slots 36 in inner body 34. Other forms of mounting circuit board 28 onto inner body 34 are optionally employed, such as forming ribs (not shown) inside inner body 34 and mounting circuit board 28 onto the ribs, or forming mounts (not shown) inside inner body 34 and mounting circuit board 28 on the mounts. Inner body 34 is preferably of brass for its electrical and mechanical properties, but any conductive material with suitable mechanical properties could be used instead. A port seal (weather seal) 38 is connected to inner body 34 by snapping a latch portion 40 of port seal 38 over an outer lip 46 of inner body 34. Port seal (weather seal) 38 is preferably silicone rubber because of its resistance to compression set. An insulator 42 preferably of polypropylene fits over a male contact 32 of circuit board 28, while a contact insulator 22 fits over a female contact 30 of circuit board 28. An O-ring 26 is preferably fitted over a portion 48 of contact insulator 22.

Filter housing 10 is preferably assembled by placing O-ring 26 over portion 48 of contact insulator 22 and then placing contact insulator 22 over female contact 30. Insulator 42 is placed over male contact 32. Port seal 38 is fitted onto inner body 34, after which circuit board 28 is fitted into slots 36 to form an assembly. The assembly is then fitted into outer body 12 as far as it can go, at which time O-ring 26 is lightly compressed between a flange 50 of outer body 12 and a rim 24 of contact insulator 22. The interference fit between inner body 34, outer body 12, and port seal (weather seal) 38 holds filter housing 10 together.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A filter housing, comprising:

an outer body;

an inner body;

a first portion of the outer body shaped as a wrench hex;

a second portion of the outer body having texturing thereon sufficient to permit hand tightening of the filter housing into an equipment port;

a third portion of the outer body having a smooth surface effective to permit affixing indicia thereon;

an integral weather seal mounted onto a portion of the inner body;

wherein the inner body includes a plurality of slots therein, and a circuit board is mounted in the slots;

a male contact connected to one side of the circuit board;

a female contact connected to another side of the circuit board;

a first insulator affixed over a portion of the male contact;

a second insulator affixed over the female contact;

the second insulator including a rim with a section of the second insulator between the rim and a free end of the second insulator; and an O-ring fitted over the section of the second insulator.

2. A filter housing, comprising:

an outer body;

an inner body;

a first portion of the outer body shaped as wrench hex;

a second portion of the outer body having texturing thereon sufficient to permit hand tightening of the filter housing into an equipment port;

a third portion of the outer body having a smooth surface effective to permit affixing indicia thereon;

wherein the inner body includes a plurality of slots therein, and a circuit board is mounted in the slots;

a male contact connected to one side of the circuit board;

a female contact connected to another side of the circuit board;

a first insulator affixed over a portion of the male contact;

a second insulator affixed over the female contact;

the second insulator including a rim with a section of the second insulator between the rim and a free end of the second insulator; and an O-ring fitted over the section of the second insulator.

3. A method for manufacturing a filter housing, comprising the steps of:

forming an outer body;

forming at least one textured portion on the outer body, wherein the textured portion is sufficient to permit hand tightening of the filter housing into an equipment port;

forming a smooth portion on the outer body of sufficient size effective to affix indicia on the smooth portion;

forming a wrench hex on the outer body sufficient to permit wrench tightening of the filter housing into the equipment port;

forming an inner body;

fitting the inner body into the outer body such that the inner body and outer body are connected by an interference fit; and affixing a weather seal onto an end of the inner body which end contains internal threads for affixing the filter housing onto the equipment port.

4. A method according to claim 3, further comprising the steps of:

providing a circuit board having a male contact and a female contact affixed thereto;

fitting a first insulator over a portion of the male contact;

fitting a second insulator over the female contact, wherein the second insulator includes a rim with a section of the second insulator between the rim and a free end of the second insulator;

fitting an O-ring fitted over the section of the second insulator;

forming a plurality of slots in the inner body; and connecting the circuit board into the plurality of slots before the inner body is fitted into the outer body.

5. A method for manufacturing a filter housing, comprising the steps of:

forming an outer body;

forming at least one textured portion on the outer body wherein the textured portion is sufficient to permit hand tightening of the filter housing into an equipment port;

forming smooth portion on the outer body of sufficient size effective to affix indicia on the smooth portion;

forming a wrench hex on the outer body sufficient to permit wrench tightening of the filter housing into the equipment port;

forming an inner body; and fitting the inner body into the outer body such that the inner body and outer body are connected by an interference fit;

providing a circuit board having a male contact and a female contact affixed thereto;

fitting a first insulator over a portion of the male contact;

fitting a second insulator over the female contact, wherein the second insulator includes a rim with a section of the second insulator between the rim and a free end of the second insulator;

fitting an O-ring fitted over the section of the second insulator;

forming a plurality of slots in the inner body; and connecting the circuit board into the plurality of slots before the inner body is fitted into the outer body.

6. A filter housing, comprising:

an outer body;

an inner body;

a portion of the outer body shaped as a wrench hex;

means, on the outer body, for permitting hand tightening of the filter housing into an equipment port;

means, on the outer body, for permitting affixing indicia thereon;

an integral weather seal mounted onto a portion of the inner body;

wherein the inner body includes means for mounting a circuit board therein;

a male contact connected to one side of the circuit board;

a female contact connected to another side of the circuit board;

a first insulator affixed over a portion of the male contact;

a second insulator affixed over the female contact;

the second insulator including a rim with a section of the second insulator between the rim and a free end of the second insulator; and an O-ring fitted over the section of the second insulator.

7. A filter housing, comprising:

an outer body;

an inner body;

a portion of the outer body shaped as a wrench hex;

means, on the outer body, for permitting hand tightening of the filter housing into an equipment port;

means, on the outer body, for permitting affixing indicia thereon;

wherein the inner body includes means for mounting a circuit board therein;

a male contact connected to one side of the circuit board;

a female contact connected to another side of the circuit board;

a first insulator affixed over a portion of the male contact;

a second insulator affixed over the female contact;

the second insulator including a rim with a section of the second insulator between the rim and a free end of the second insulator; and an O-ring fitted over the section of the second insulator.

* * * * *